US008444814B2

(12) United States Patent
Levit

(10) Patent No.: US 8,444,814 B2
(45) Date of Patent: May 21, 2013

(54) PAPER COMPRISING PIPD FLOC AND PROCESS FOR MAKING THE SAME

(76) Inventor: Mikhail R. Levit, Glen Allen, VA (US)

( * ) Notice: Subject to any disclaimer, the term of this patent is extended or adjusted under 35 U.S.C. 154(b) by 995 days.

(21) Appl. No.: 12/084,007

(22) PCT Filed: Dec. 19, 2006

(86) PCT No.: PCT/US2006/062270

§ 371 (c)(1),
(2), (4) Date: Apr. 23, 2008

(87) PCT Pub. No.: WO2007/076334

PCT Pub. Date: Jul. 5, 2007

(65) Prior Publication Data

US 2009/0250181 A1 Oct. 8, 2009

Related U.S. Application Data

(60) Provisional application No. 60/753,230, filed on Dec. 21, 2005.

(51) Int. Cl.
*D21H 13/20* (2006.01)

(52) U.S. Cl.
USPC ..... 162/157.2; 162/157.1

(58) Field of Classification Search
USPC ..... 528/183, 186, 193, 342, 423; 162/157.2, 162/164.1, 164.3
See application file for complete search history.

(56) References Cited

U.S. PATENT DOCUMENTS

| | | | | |
|---|---|---|---|---|
| 3,756,908 | A | 9/1973 | Gross | |
| 4,060,451 | A | 11/1977 | Uchiyama et al. | |
| 4,472,241 | A | 9/1984 | Provost | |
| 4,515,656 | A * | 5/1985 | Memeger, Jr. | 162/101 |
| 5,084,136 | A | 1/1992 | Haines et al. | |
| 5,171,402 | A | 12/1992 | Haines et al. | |
| 5,223,094 | A * | 6/1993 | Kirayoglu et al. | 162/145 |
| 5,314,742 | A * | 5/1994 | Kirayoglu et al. | 442/378 |
| 5,674,969 | A | 10/1997 | Sikkema et al. | |
| 5,833,807 | A * | 11/1998 | Ramachandran et al. | 162/157.3 |
| 5,965,072 | A * | 10/1999 | Hesler | 264/14 |
| 6,176,972 | B1 | 1/2001 | Oriaran et al. | |
| 2002/0142689 | A1 * | 10/2002 | Levit | 442/381 |
| 2005/0230072 | A1 * | 10/2005 | Levit | 162/146 |

FOREIGN PATENT DOCUMENTS

| | | |
|---|---|---|
| EP | 0 178943 B1 | 4/1986 |
| EP | 0 994 215 B1 | 6/2003 |
| GB | 1 520 574 | 8/1978 |
| WO | WO 99/27169 A1 * | 6/1999 |

OTHER PUBLICATIONS

"Glass Transition Temperature, Tg" Information Sheet, siliconfareast.com, 2004, [retrieved on Jan. 29, 2011], Retrieved from the Internet: <URL:http://www.siliconfareast.com/tg.htm>.*

Hageman, et al.—An ab initio study of the structual and physical properties of a novel rigid-rod polymer;PIPD-Polymer, 1999, 40, 1313, Elsevier Science Ltd.

Klop et al.—XRD study of the new rigid-rod polymer fibre PIPD, Polymer 1998, 39, 5987, Elsevier Science Ltd.

Sikkema,—Design, synthesis and properties of a novel rigid rod polymer, PIPD or "M5": high modulus and tenacity fibres with substantial compressive strength. Polymer, 1998, 39, 5981, Elsevier Science Ltd.

Brew et al.—The properties of PIPD-fibre/epoxy composites. Composites Science and Technology, 1999, 59, 1109, Elsevier Science Ltd.

Van Der Jagt et al., The potential of a new rigid-rod polymer fibre ('5') in advanced composite structures. Polymer 1999, 40, 1035 Elsevier Science Ltd.

* cited by examiner

*Primary Examiner* — Mark Halpern
*Assistant Examiner* — Dennis Cordray

(57) ABSTRACT

The invention concerns a paper comprising polypyridobisimidazole floc having a length of from 1.0 to 15 mm, where the apparent density of the paper is from 0.1 to 0.4 g/cm$^3$ and the tensile strength of the paper in N/cm is at least 0.000052X*Y, where X is the volume portion of polypyridobisimidazole in the total solids of the paper in % and Y is basis weight of the paper in g/m$^2$.

8 Claims, No Drawings

PAPER COMPRISING PIPD FLOC AND PROCESS FOR MAKING THE SAME

CROSS REFERENCE TO RELATED APPLICATIONS

This application claims benefit of U.S. Application No. 60/753,230 filed Dec. 21, 2005, the disclosure of which is incorporated herein by reference.

FIELD OF THE INVENTION

The invention relates to a self-bonding polypyridobisimidazole floc, paper comprising such floc and a process for making the same.

BACKGROUND OF THE INVENTION

Papers made from high performance materials, have been developed to provide papers with improved strength and/or thermal stability. Aramid paper, for example, is synthetic paper composed of aromatic polyamides. Because of its heat and flame resistance, electrical insulating properties, toughness and flexibility, the paper has been used as electrical insulation material and a base for aircraft honeycombs. Of these materials, a paper comprising Nomex® fiber of DuPont (U.S.A.) is manufactured by mixing poly(metaphenylene isophthalamide) floc and fibrids in water and then subjecting the mixed slurry to a papermaking process with following hot calendering of the formed web. This paper is known to have excellent electrical insulation properties and with strength and toughness, which remains high even at high temperatures.

There is an ongoing need for high performance papers with improved properties.

SUMMARY OF THE INVENTION

In some aspects, the invention concerns a paper comprising the floc from polypyridobisimidazole, said floc having a length of from 1.0 to 15 mm, where the apparent density of the paper is from 0.1 to 0.4 g/cm$^3$ and the tensile strength of the paper in N/cm is at least 0.000052X*Y, where X is the volume portion of polypyridobisimidazole in the total solids of the paper in % and Y is basis weight of the paper in g/m$^2$.

In some embodiments, the paper further comprises a binder material. Suitable binder materials include non-granular, fibrous or film-like, polymer fibrids.

In certain embodiments, the fibrids have an average maximum dimension of 0.2 to 1 mm. In some embodiments, the fibrids have a ratio of maximum to minimum dimension of 5:1 to 10:1. In some embodiments, the fibrids have a thickness of no more than 2 microns.

Some polymer fibrids are meta-aramid fibrids.

In some embodiments, the binder material is present in an amount of 10 to 90 wt % of the paper.

Some papers further comprise a pulp.

Also provided are processes for making polypyridobisimidazole paper comprising the steps of:

- combining polypyridobisimidazole floc, water, and optionally other ingredients to form a dispersion;
- blending the dispersion to form a slurry;
- removing at least a portion of the water to yield a wet paper composition; and
- drying the wet paper composition.

In some embodiments, the processes comprise the additional step of densifying the paper composition by calendering or compression at some point in the process.

In certain embodiments, the papers have an apparent density of 0.41 to 1.3 g/cm$^3$.

In some embodiments, processes for making polypyridobisimidazole paper comprises the steps of:

- combining 5 to 65 parts by weight PIPD floc and 35-95 parts by weight binder material, based on the total weight of the floc and binder material, to form a dispersion;
- blending the dispersion to form a slurry;
- removing at least a portion of the water to yield a wet paper composition; and
- drying the wet paper composition.

In some embodiments, the processes comprise the additional step of heat treating the paper composition at or above the glass transition temperature of the binder material. In some embodiments, the heat treatment is either followed by or includes calendering the paper composition.

Some processes comprise the additional step of densifying the paper composition by calendering or compression at some point in the process.

In certain processes the binder material comprises non-granular, fibrous or film-like, meta-aramid fibrids having an average maximum dimension of 0.2 to 1 mm.

In some processes the meta-aramid fibrids have a ratio of maximum to minimum dimension of 5:1 to 10:1, and a thickness of no more than 2 microns.

DETAILED DESCRIPTION OF ILLUSTRATIVE EMBODIMENTS

In some embodiments, the invention concerns a paper comprising polypyridobisimidazole floc having a length of from 1.0 to 15 mm, where the apparent density of the paper is from 0.1 to 0.4 g/cm$^3$ and the tensile strength of the paper in N/cm is at least 0.000052X*Y, where X is the volume portion of polypyridobisimidazole in the total solids of the paper in % and Y is basis weight of the paper in g/m$^2$.

For the purpose of this invention, "Papers" are flat sheets producible on a paper machine, such as a Fourdrenier or inclined-wire machine. In preferred embodiments these sheets are generally thin, fibrous sheets comprised of a network of randomly oriented, short fibers laid down from a water suspension and bonded together by their own chemical attraction, friction, entanglement, binder, or a combination thereof.

The paper can have basis weight from about 10 to about 700 g/m$^2$ and a thickness from about 0.015 to about 2 mm.

The floc of this invention means short lengths of fiber, shorter than staple fiber. The length of floc is about 0.5 to about 15 mm and a diameter of 4 to 50 micrometers, preferably having a length of 1 to 12 mm and a diameter of 8 to 40 micrometers. Floc that is less than about 1 mm does not add significantly to the strength of the material in which it is used. Floc or fiber that is more than about 15 mm often does not function well because the individual fibers may become entangled and cannot be adequately and uniformly distributed throughout the material or slurry. Floc is generally made by cutting continuous spun filaments or tows into specific-length pieces using conventional fiber cutting equipment. Generally this cutting is made without significant or any fibrillation of the fiber.

The instant invention utilizes polypyridobisimidazole fiber. This fiber is from a rigid rod polymer that is of high strength. The polypyridobisimidazole polymer of this fiber has an inherent viscosity of at least 20 dl/g or at least 25 dl/g or at least 28 dl/g. Such fibers include PIPD fiber (also known as M5® fiber and fiber made from poly[2,6-diimidazo[4,5-b:4,5-e]-pyridinylene-1,4(2,5-dihydroxy)phenylene). PIPD fiber is based on the structure:

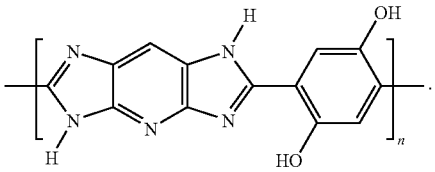

Polypyridobisimidazole fiber can be distinguished from the well known commercially available PBI fiber or polybenzimidazole fiber in that that polybenzimidazole fiber is a polybibenzimidazole. Polybibenzimidazole fiber is not a rigid rod polymer and has low fiber strength and low tensile modulus when compared to polypyridobisimidazoles.

PIPD fibers have been reported to have the potential to have an average modulus of about 310 GPa (2100 grams/denier) and an average tenacities of up to about 5.8 Gpa (39.6 grams/denier). These fibers have been described by Brew, et al., *Composites Science and Technology* 1999, 59, 1109; Van der Jagt and Beukers, *Polymer* 1999, 40, 1035; Sikkema, *Polymer* 1998, 39, 5981; Klop and Lammers, *Polymer,* 1998, 39, 5987; Hageman, et al., *Polymer* 1999, 40, 1313.

One method of making rigid rod polypyridobisimidazole polymer is disclosed in detail in U.S. Pat. No. 5,674,969 to Sikkema et al. Polypyridobisimidazole polymer may be made by reacting a mix of dry ingredients with a polyphosphoric acid (PPA) solution. The dry ingredients may comprise pyridobisimidazole-forming monomers and metal powders. The polypyridobisimidazole polymer used to make the rigid rod fibers used in the fabrics of this invention should have at least 25 and preferably at least 100 repetitive units.

For the purposes of this invention, the relative molecular weights of the polypyridobisimidazole polymers are suitably characterized by diluting the polymer products with a suitable solvent, such as methane sulfonic acid, to a polymer concentration of 0.05 g/dl, and measuring one or more dilute solution viscosity values at 30° C. Molecular weight development of polypyridobisimidazole polymers of the present invention is suitably monitored by, and correlated to, one or more dilute solution viscosity measurements. Accordingly, dilute solution measurements of the relative viscosity ("$V_{rel}$" or "$\eta_{rel}$" or "$n_{rel}$") and inherent viscosity ("$V_{inh}$" or "$\eta_{inh}$" or "$n_{inh}$") are typically used for monitoring polymer molecular weight. The relative and inherent viscosities of dilute polymer solutions are related according to the expression $$V_{inh}=\ln(V_{rel})/C,$$

where ln is the natural logarithm function and C is the concentration of the polymer solution. $V_{rel}$ is a unitless ratio of the polymer solution viscosity to that of the solvent free of polymer, thus $V_{inh}$ is expressed in units of inverse concentration, typically as deciliters per gram ("dl/g"). Accordingly, in certain aspects of the present invention the polypyridoimidazole polymers are produced that are characterized as providing a polymer solution having an inherent viscosity of at least about 20 dl/g at 30° C. at a polymer concentration of 0.05 g/dl in methane sulfonic acid. Because the higher molecular weight polymers that result from the invention disclosed herein give rise to viscous polymer solutions, a concentration of about 0.05 g/dl polymer in methane sulfonic acid is useful for measuring inherent viscosities in a reasonable amount of time.

Exemplary pyridobisimidazole-forming monomers useful in this invention include 2,3,5,6-tetraaminopyridine and a variety of acids, including terephthalic acid, bis-(4-benzoic acid), oxy-bis-(4-benzoic acid), 2,5-dihydroxyterephthalic acid, isophthalic acid, 2,5-pyridodicarboxylic acid, 2,6-napthalenedicarboxylic acid, 2,6-quinolinedicarboxylic acid, or any combination thereof. Preferably, the pyridobisimidazole forming monomers include 2,3,5,6-tetraaminopyridine and 2,5-dihydroxyterephthalic acid. In certain embodiments, it is preferred that that the pyridobisimidazole-forming monomers are phosphorylated. Preferably, phosphorylated pyridobisimidazole-forming monomers are polymerized in the presence of polyphosphoric acid and a metal catalyst.

Metal powders can be employed to help build the molecular weight of the final polymer. The metal powders typically include iron powder, tin powder, vanadium powder, chromium powder, and any combination thereof.

The pyridobisimidazole-forming monomers and metal powders are mixed and then the mixture is reacted with polyphosphoric acid to form a polypyridoimidazole polymer solution. Additional polyphosphoric acid can be added to the polymer solution if desired. The polymer solution is typically extruded or spun through a die or spinneret to prepare or spin the filament.

PIPD pulp can be made from conventional pulp making process well known to those skilled in the art. See, for example, Handbook for Pulp & Paper Technologists, Smook, Gary A.; Kocurek, M. J.; Technical Association of the Pulp and Paper Industry; Canadian Pulp and Paper Association, and U.S. Pat. Nos. 5,171,402 and 5,084,136.

PIPD pulp has a high affinity for water, meaning the pulp has a high equilibrium moisture content following the removal of liquid water. This is believed to help eliminate static effects that cause clumping and defects normally associated with other high performance pulps that do not absorb water to the same degree and are afflicted with static problems. In addition, both PIPD pulp and PIPD floc have the surprising attribute of self-bonding; that is, papers formed solely from the pulp or solely from the floc have a surprisingly higher strength than would be anticipated by the prior art papers made from high performance fibers. While not wanting to be bound by theory, it is believed that this higher strength is due to hydrogen bonding between the surfaces of the pieces of pulp and floc.

As used herein, "moisture content" is measured in accordance with TAPPI Test Method T210.

When the term "maximum dimension" is used, it refers to the longest size measure (length, diameter, etc.) of the object.

Pulp Manufacture

Pulp manufacture, is illustrated, for example, by a process comprising:

(a) combining pulp ingredients including PIPD fiber having an average length of no more than 10 cm, and water being 95 to 99 weight percent of the total ingredients;

(b) mixing the ingredients to a substantially uniform slurry;

(c) refining the slurry by simultaneously fibrillating, cutting and masticating the PIPD fiber into irregularly shaped fibrillated fibrous structures with stalks and fibrils; and substantially uniformly dispersing all solids in the refined slurry; and (d) removing water from the refined slurry to no more than 60 total weight percent water, thereby producing a PIPD pulp with fibrous structures having an average maximum dimension of no more than 5 mm and a length-weighted average length of no more than 2.0 mm Combining Step In the combining step, a dispersion of pulp ingredients and water is formed. Water is added in a concentration of 95 to 99 weight percent of the total ingredients, and preferably 97 to 99 weight percent of the total ingredients. Further, the water can be added first and the pulp ingredients second. Then other ingredients can be added at a rate to optimize dispersion in the water while simultaneously mixing the combined ingredients.

Mixing Step

In the mixing step, the ingredients are mixed to form a substantially uniform slurry. By "substantially uniform" is meant that random samples of the slurry contain the same weight percent of the concentration of each of the starting ingredients as in the total ingredients in the combination step plus or minus 10 weight percent, preferably 5 weight percent and most preferably 2 weight percent. The mixing can be accomplished in any vessel containing rotating blades or some other agitator. The mixing can occur after the ingredients are added or while the ingredients are being added or combined.

Refining Step

In the refining step, the pulp ingredients are simultaneously refined, converted or modified as follows. The PIPD fibers are fibrillated, cut and masticated to irregularly shaped fibrous structures having stalks and fibrils. All solids are dispersed such that the refined slurry is substantially uniform. The refining step preferably comprises passing the mixed slurry through one or more disc refiner, or recycling the slurry back through a single refiner. By the term "disc refiner" is meant a refiner containing one or more pair of discs that rotate with respect to each other thereby refining ingredients by the shear action between the discs. In one suitable type of disc refiner, the slurry being refined is pumped between closely spaced circular rotor and stator discs rotatable with respect to one another. Each disc has a surface, facing the other disc, with at least partially radially extending surface grooves. A preferred disc refiner that can be used is disclosed in U.S. Pat. No. 4,472,241. If necessary for uniform dispersion and adequate refining, the mixed slurry can be passed through the disc refiner more than once or through a series of at least two disc refiners. When the mixed slurry is refined in only one refiner, there is a tendency for the resulting slurry to be inadequately refined and non-uniformly dispersed. Conglomerates or aggregates entirely or substantially of one solid ingredient, or the other, or both, or all three if three are present, can form rather than being dispersed forming a substantially uniform dispersion. Such conglomerates or aggregates have a greater tendency to be broken apart and dispersed in the slurry when the mixed slurry is passed through the refiner more than once or passed through more than one refiner. Following refining the pulp may be passed through screens to remove excessively long fibers, which may then be returned to the refiners until they are cut to an acceptable length or concentration.

Optional Pre-Refining Step

Prior to combining all ingredients together, the PIPD fiber may need to be shortened for the best overall effect. One way this is done is by combining water with the fiber, which is longer than 2 cm, but shorter than 10 cm in a bucket of fewer than about 5 gallons capacity. Then the water and fiber are mixed to form a first suspension and processed through a first disc refiner to shorten the fiber. The disc refiner cuts the long fiber to an average length of no more than 2 cm. The disc refiner will also partially fibrillate and partially masticate the fiber. This process may be repeated using small batches of water and fiber with the small batches combined to create enough volume to mix and pump through the refiner as previously described. Water is added or decanted, if necessary, to increase the water concentration to 95-99 weight percent of the total ingredients. The combined batches can then be mixed, if necessary, to achieve a substantially uniform slurry for refining.

Water Removing Step

The water in the pulp may be removed by any available means to separate the fibrous solids from the water, for example, by filtering, screening, or pressing the pulp.

Paper Manufacture from Pulp

Paper-manufacture from PIPD pulp is illustrated by a process comprising:

a) preparing an aqueous dispersion of PIPD pulp,
b) diluting the aqueous dispersion in a paper making mold cavity,
c) draining the water from the aqueous dispersion to yield a wet paper,
d) dewatering and drying the resultant paper, and
e) conditioning the paper for physical property testing.

Paper Manufacture from Floc

Paper manufacture from PIPD floc is illustrated by a process comprising:

a) preparing an aqueous dispersion of PIPD floc,
b) diluting the aqueous dispersion in a paper making mold cavity,
c) draining the water from the aqueous dispersion to yield a wet paper,
d) dewatering and drying the resultant paper, and
e) conditioning the paper for physical property testing.

Paper manufacturing from PIPD pulp and/or floc can comprise an additional step of densifying of the formed paper by calendering at ambient or increased temperature.

Examples below demonstrate a preparation and properties of papers based on PIPD pulp, PIPD floc and other types of the floc.

Test Methods

In the non-limiting examples that follow, the following test methods were employed to determine various reported characteristics and properties. ASTM refers to the American Society of Testing Materials. TAPPI refers to Technical Association of Pulp and Paper Industry.

Thickness and Basis Weight of papers were determined in accordance with ASTM D 645 and ASTM D 646 correspondingly. Thickness measurements were used in the calculation of the apparent density of the papers.

Density (Apparent Density) of papers was determined in accordance with ASTM D 202.

Tensile Strength and Tensile Stiffness were determined for papers and composites of this invention on an Instron-type testing machine using test specimens 2.54 cm wide and a gage length of 18 cm in accordance with ASTM D 828.

Canadian Standard Freeness (CSF) of the pulp is a measure of the rate, at which a dilute suspension of pulp may be drained, and was determined in accordance with TAPPI Test Method T 227.

Fiber length was measured in accordance with TAPPI Test Method T 271 using the Fiber Quality Analyzer manufactured by OpTest Equipment Inc.

Examples 1-8 demonstrate a preparation and the properties of papers based on the compositions of PIPD pulp with different types of the floc. Comparative example A shows that similar paper with para-aramid pulp in the composition instead of PIPD pulp is much weaker vs. the paper from the example 6 (both papers contain 50 wt % of the same para-aramid floc).

Tensile strength in N/cm is more or equal to 0.00057X*Y, where X is the volume portion of PIPD pulp in the total solids of the paper in % and Y is basis weight of the paper in $g/m^2$.

Tensile strength in N/cm is more or equal to 0.000052X*Y, where X is the volume portion of PIPD pulp in the total solids of the paper in % and Y is basis weight of the paper in $g/m^2$.

Much higher strength of PIPD pulp based papers gave them significant advantage in the paper manufacturing and in the further processing of the paper into the final application (it is possible to go to lighter basis weight and/or to use more simple and cheaper equipment).

Examples 9-16 demonstrate a preparation of calendered papers based on the formed papers from examples 1-8. For many composite applications, high density structure is desired, and calendering allows to reach such density.

In the honeycombs and other structural applications, in many cases not all free volume of the paper is filled with the resin. Optimization of property/weight ratio gives resin impregnated structures with some free volume/voids. Examples 17 and 18 demonstrate resin impregnated papers (with relatively small resin content) based on PIPD pulp and its composition with para-aramid floc. In comparative example B, resin impregnated paper based on the commercial composition of para-aramid floc and meta-aramid fibrids is described. It can be seen that, at about the same resin content, PIPD pulp based papers provide the same or higher stiffness and much higher strength.

EXAMPLE 1

3.2 g (of the dry weight) of the wet PIPD pulp with CSF of about 200 ml was placed in a Waring Blender with 300 ml of water and agitated for 1 min. The dispersion was poured into an approximately 21×21 cm handsheet mold and mixed with additional 5000 g of water.

A wet-laid sheet was formed. The sheet was placed between two pieces of blotting paper, hand couched with a rolling pin, and dried in a handsheet dryer at 190° C.

The composition and properties of the final paper are shown in table 1.

EXAMPLE 2

0.8 g (of the dry weight) of the wet PIPD pulp with CSF of about 200 ml was placed in a Waring Blender with 300 ml of water and agitated for 1 min. 2.4 g of meta-aramid floc were placed with about 2500 g water in the laboratory pulp disintegrator and agitated for 3 minutes. The both dispersions were poured together into an approximately 21×21 cm handsheet mold and mixed with additional 5000 g of water.

The meta-aramid floc was poly (metaphenylene isophthalamide) floc of linear density 0.22 tex (2.0 denier) and length of 0.64 cm (sold by DuPont under the trade name NOMEX®).

A wet-laid sheet was formed. The sheet was placed between two pieces of blotting paper, hand couched with a rolling pin, and dried in a handsheet dryer at 190° C.

The composition and properties of the final paper are shown in table 1.

EXAMPLE 3

0.8 g (of the dry weight) of the wet PIPD pulp with CSF of about 200 ml was placed in a Waring Blender with 300 ml of water and agitated for 1 min. 2.4 g of carbon fiber were placed with about 2500 g water in the laboratory pulp disintegrator and agitated for 3 minutes. The both dispersions were poured together into an approximately 21×21 cm handsheet mold and mixed with additional 5000 g of water.

The carbon fiber was PAN-based FORTAFIL® 150 carbon fiber (about 3 mm long) sold by Toho Tenax America, Inc.

A wet-laid sheet was formed. The sheet was placed between two pieces of blotting paper, hand couched with a rolling pin, and dried in a handsheet dryer at 190 C.

The composition and properties of the final paper are shown in table 1.

EXAMPLE 4

1.6 g (of the dry weight) of the wet PIPD pulp with CSF of about 300 ml was placed in a Waring Blender with 800 ml of water and agitated for 1 min. 1.6 g of meta-aramid floc were placed with about 2500 g water in the laboratory pulp disintegrator and agitated for 3 minutes. The both dispersions were poured together into an approximately 21×21 cm handsheet mold and mixed with additional 5000 g of water.

The meta-aramid floc was the same as in example 2.

A wet-laid sheet was formed. The sheet was placed between two pieces of blotting paper, hand couched with a rolling pin, and dried in a handsheet dryer at 190 C.

The composition and properties of the final paper are shown in table 1.

EXAMPLE 5

1.6 g (of the dry weight) of the wet PIPD pulp with CSF of about 300 ml was placed in a Waring Blender with 800 ml of water and agitated for 1 min. 1.6 g of carbon fiber were placed with about 2500 g water in the laboratory pulp disintegrator and agitated for 3 minutes. The both dispersions were poured together into an approximately 21×21 cm handsheet mold and mixed with additional 5000 g of water.

The carbon fiber was the same as in example 3.

A wet-laid sheet was formed. The sheet was placed between two pieces of blotting paper, hand couched with a rolling pin, and dried in a handsheet dryer at 190 C.

The composition and properties of the final paper are shown in table 1.

EXAMPLE 6

1.6 g (of the dry weight) of the wet PIPD pulp with CSF of about 300 ml was placed in a Waring Blender with 800 ml of water and agitated for 1 min. 1.6 g of para-aramid floc were placed with about 2500 g water in the laboratory pulp disintegrator and agitated for 3 minutes. The both dispersions were poured together into an approximately 21×21 cm handsheet mold and mixed with additional 5000 g of water.

The para-aramid floc was poly (para-phenylene terephthalamide) floc having a linear density of about 0.16 tex and cut length of about 0.67 cm (sold by E. I. de Pont de Nemours and Company under trademark KEVLAR® 49).

A wet-laid sheet was formed. The sheet was placed between two pieces of blotting paper, hand couched with a rolling pin, and dried in a handsheet dryer at 190 C.

The composition and properties of the final paper are shown in table 1.

EXAMPLE 7

2.4 g (of the dry weight) of the wet PIPD pulp with CSF of about 300 ml was placed in a Waring Blender with 800 ml of water and agitated for 1 min. 0.8 g of meta-aramid floc were placed with about 2500 g water in the laboratory pulp disintegrator and agitated for 3 minutes. The both dispersions were poured together into an approximately 21×21 cm handsheet mold and mixed with additional 5000 g of water.

The meta-aramid floc was the same as in example 2.

A wet-laid sheet was formed. The sheet was placed between two pieces of blotting paper, hand couched with a rolling pin, and dried in a handsheet dryer at 190 C.

The composition and properties of the final paper are shown in table 1.

EXAMPLE 8

2.4 g (of the dry weight) of the wet PIPD pulp with CSF of about 300 ml was placed in a Waring Blender with 800 ml of water and agitated for 1 min. 0.8 g of carbon fiber were placed with about 2500 g water in the laboratory pulp disintegrator and agitated for 3 minutes. The both dispersions were poured together into an approximately 21×21 cm handsheet mold and mixed with additional 5000 g of water.

The carbon fiber was the same as in example 3.

A wet-laid sheet was formed. The sheet was placed between two pieces of blotting paper, hand couched with a rolling pin, and dried in a handsheet dryer at 190 C.

The composition and properties of the final paper are shown in table 1.

EXAMPLES 9-16

The paper samples were produced as in examples 1-8 respectively, but, after drying, additionally calendered in the nip of metal-metal calender with work roll diameter of 20.3 cm at temperature of about 300 C. and linear pressure of about 1200 N/cm.

The properties of the final papers are shown in table 1.

EXAMPLES 17 and 18

Resin impregnated papers were prepared by the impregnation of the papers from Examples 9 and 14 with a solvent-based phenolic resin (PLYOPHEN 23900 from the Durcz Corporation) following by removing any excess resin from the surface with blotting paper and curing in an oven by ramping up the temperature as follows: heating from room temperature to 82° C. and holding at this temperature for 15 minutes, increasing the temperature to 121° C. and holding at this temperature for another 15 minutes and increasing the temperature to 182° C. and holding at this temperature for 60 minutes. Properties of the final impregnated papers are shown in table 2.

COMPARATIVE EXAMPLE A

The paper was prepared similar to example 6, but instead of wet PIPD pulp, wet p-aramid pulp with CSF of about 200 ml, sold by DuPont as KEVLAR® pulp grade 1F361, was used.

The properties of the final paper are shown in table 1.

COMPARATIVE EXAMPLE B 0.64 g (of the dry weight) of meta-aramid fibrids with CSF of about 40 ml and 2.56 g of para-aramid floc were placed with about 2500 g water in the laboratory pulp disintegrator and agitated for 3 minutes. The dispersion was poured into an approximately 21×21 cm handsheet mold and mixed with additional 5000 g of water.

The para-aramid floc was the same as in example 6.

The meta-aramid fibrids were made from poly(metaphenylene isophthalamide) as described in U.S. Pat. No. 3,756,908.

A wet-laid sheet was formed. The sheet was placed between two pieces of blotting paper, hand couched with a rolling pin, and dried in a handsheet dryer at 190 C.

After that, the paper was impregnated with phenolic resin as described in examples 17 and 18.

The composition and properties of the final impregnated paper are shown in table 2.

TABLE 1

Properties of the paper samples with basis weight 68 g/m$^2$.

| | Paper composition, wt. % | | | | Paper | Volume % of | Boundary | Tensile |
|---|---|---|---|---|---|---|---|---|
| Ex. | PIPD Pulp | m-aramid floc | p-aramid floc | carbon fiber | density, g/cm$^3$ | PIPD pulp in solids | strength, N/cm | strength of the paper, N/cm |
| 1 | 100 | — | — | — | 0.36 | 100 | 3.85 | 4.90 |
| 2 | 25 | 75 | — | — | 0.28 | 21.3 | 0.82 | 1.51 |
| 3 | 25 | — | — | 75 | 0.18 | 25.0 | 0.96 | 2.50 |
| 4 | 50 | 50 | — | — | 0.29 | 44.8 | 1.73 | 4.24 |
| 5 | 50 | — | — | 50 | 0.22 | 50.0 | 1.93 | 4.59 |
| 6 | 50 | — | 50 | — | 0.22 | 45.9 | 1.77 | 3.68 |
| 7 | 75 | 25 | — | — | 0.32 | 70.9 | 2.73 | 5.92 |
| 8 | 75 | — | — | 25 | 0.29 | 75.0 | 2.89 | 7.23 |
| 9 | 100 | — | — | — | 1.16 | 100 | — | 9.22 |
| 10 | 25 | 75 | — | — | 0.55 | 21.3 | — | 1.79 |
| 11 | 25 | — | — | 75 | 0.82 | 25.0 | — | 0.70 |
| 12 | 50 | 50 | — | — | 0.66 | 44.8 | — | 5.15 |
| 13 | 50 | — | — | 50 | 0.80 | 50.0 | — | 2.98 |
| 14 | 50 | — | 50 | — | 1.02 | 45.9 | — | 9.49 |
| 15 | 75 | 25 | — | — | 0.86 | 70.9 | — | 9.94 |
| 16 | 75 | — | — | 25 | 0.89 | 75.0 | — | 8.23 |
| A | p-aramid pulp-50%, p-aramid floc - 50% | | | | 0.18 | 0 | — | 1.45 |

TABLE 2

Properties of the resin impregnated papers based on 68 g/m$^2$ calendered papers

| Ex. | Paper composition, wt. % PIDP pulp | p-aramid floc | m-aramid fibrids | Resin content in the composite, wt. % | Specific tensile stiffness, (N/cm)/(g/m$^2$) | Tensile strength, N/cm |
|---|---|---|---|---|---|---|
| 17 | 100 | — | — | 15 | 74 | 114 |
| 18 | 50 | 50 | — | 26 | 98 | 109 |
| B | — | 80 | 20 | 21 | 77 | 58 |

Additional examples are provided below.

EXAMPLE 19

The pulp of this invention was produced from a feedstock of PIPD staple having a cut length less than 2 inches and having a filament linear density of about 2 dpf (2.2 dtex per filament). The PIPD staple and water together were fed directly into a Sprout-Waldron 12" Single Disc Refiner using a 5 mil plate gap setting and pre-pulped to reach an acceptable processing length in the range of 13 mm.

The pre-pulped PIPD fibers were then added to a highly agitated mixing tank and mixed to form a pumpable and substantially uniform slurry of about 1.5 to 2.0 weight percent of the total ingredients concentration. The slurry was then re-circulated and refined through a Sprout-Waldron 12" Single Disc Refiner.

The refiner simultaneously fibrillated, cut, and masticated the pre-pulped PIPD fiber to irregularly shaped fibrous structures having stalks and fibrils that were dispersed substantially uniformly in the refined slurry.

This refined slurry was then filtered using a filter bag and was dewatered through pressing to form PIPD pulp. When tested, the fibrous structures in the pulp had an average maximum dimension of no more than 5 mm and a length-weighted average length of no more than 0.83 mm.

EXAMPLE 20

6.16 grams of PIPD pulp are dispersed in 2500 ml of water, producing a slurry that contains 0.25 weight percent PIPD pulp. A British Standard Disintegrator is used to achieve proper dispersion by disintegrating the slurry for a time equal to or greater than 5 minutes. The 6.16 grams of PIPD pulp equates to forming an 8 inch square sheet having a basis weight of 4.4 ounces per square yard.

The pulp slurry is then transferred to an 8-inch long by 8-inch wide by 12-inch high mold cavity. Next, an additional 5000 ml of water is added to the mold cavity to further dilute the dispersion. A perforated stirrer or equivalent is used to agitate and evenly disperse the pulp slurry in the mold cavity.

The water is then drained from the dispersion in the mold cavity through a removable forming wire that does not allow the majority of the pulp solids to pass through. After the water drains, an 8 inch square wet paper sheet is left on the mesh.

The wet paper sheet is then dewatered and dried by placing the wet paper sheet and removable wire between blotter sheets on a flat surface. Light pressure is applied evenly to the outer blotter sheets to help absorb moisture from the wet paper sheet. The dewatered paper sheet is then carefully removed from the forming wire. It is then placed between two dry blotter sheets and set on a Noble and Wood or equivalent hot plate, with the hot plate temperature set at 375° F. The paper sheet should remain on the hot plate for a total of 15 minutes to dry the paper.

Before performing physical testing on the paper, the sheet is conditioned by placing the paper in a climate-controlled area. The conditions of the climate-controlled area are 75° F. and 55 percent relative humidity.

EXAMPLE 21

The process of Example 20 can be repeated with the addition of a binder material such as meta-aramid fibrids in the initial aqueous dispersion from which the paper is made. A particularly useful paper can be made when the paper is made from an aqueous dispersion that has a solids composition of about 70 weight percent PIPD pulp and about 30 weight percent meta-aramid fibrids having an average maximum dimension of about 0.6 mm, a ratio of maximum to minimum dimension of about 7:1, and a thickness of about 1 micron.

EXAMPLE 22

Example 20 can be repeated to make a paper from PIPD cut fiber, or floc. In this case, the PIPD floc is substituted for the PIPD pulp in the aqueous dispersion, and the floc is placed with about 2500 g water in the laboratory pulp disintegrator and is agitated for 3 minutes rather than being agitated in a Waring Blender. A useful paper can be made from PIPD floc having a cut length of about 1.2 mm.

EXAMPLE 23

The process of Example 22 can be repeated with the addition of a binder material such as meta-aramid fibrids in the initial aqueous dispersion from which the paper is made. A particularly useful paper can be made when the paper is made from an aqueous dispersion that has a solids composition of about 40 weight percent PIPD floc having a cut length of about 1.2 mm and about 60 weight percent meta-aramid fibrids having an average maximum dimension of about 0.6 mm, a ratio of maximum to minimum dimension of about 7:1, and a thickness of about 1 micron.

EXAMPLE 24

The process of Example 20 can be repeated to make a paper containing both PIPD floc and PIPD pulp. In this case, a useful paper can be made by combining equal portions by weight of PIPD floc having a cut length of about 1.2 mm and PIPD pulp having a length-weighted average length of no more than 0.83 mm. The PIPD floc dispersion is prepared as per Example 22.

EXAMPLE 25

The process of Example 24 can be repeated to make a paper containing PIPD floc, PIPD pulp, and binder material. In this case, a useful paper can be made by combining in equal portions by weight of PIPD floc having a cut length of about 1.2 mm; PIPD pulp having a length-weighted average length of no more than 0.83 mm.; and meta-aramid fibrids polymer fibrids having an average maximum dimension of about 0.6 mm, a ratio of maximum to minimum dimension of about 7:1, and a thickness of about 1 micron.

What is claimed:

1. A paper comprising a floc from polypyridobisimidazole, said floc having a length of from 1.0 to 15 mm, wherein the apparent density of the paper is from 0.1 to 0.4 g/cm$^3$ and the tensile strength of the paper in N/cm is at least 0.000052X*Y, where X is the volume portion of polypyridobisimidazole in the total solids of the paper in % and Y is basis weight of the paper in g/m$^2$.

2. The paper of claim 1 further comprising a binder material.

3. The paper of claim 2, wherein the binder material includes non granular, fibrous or film-like, polymer fibrids.

4. The paper of claim 3 wherein the fibrids have an average maximum dimension of 0.2 to 1 mm.

5. The paper of claim 4 wherein the fibrids have a ratio of maximum to minimum dimension of 5:1 to 10:1.

6. The paper of claim 5, wherein the polymer fibrids are meta-aramid fibrids.

7. The paper of claim 2, wherein the binder material is present in an amount of 10 to 90 wt % of the paper.

8. The paper of claim 1, further comprising a pulp.

* * * * *